US007075024B2

(12) United States Patent
Maeda et al.

(10) Patent No.: US 7,075,024 B2
(45) **Date of Patent: *Jul. 11, 2006**

(54) COVER MEMBER FOR ILLUMINATED PUSHBUTTON SWITCH

(75) Inventors: Junya Maeda, Tokyo (JP); Takeshi Nishimura, Tokyo (JP)

(73) Assignee: Polymatech, Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/090,254

(22) Filed: Mar. 28, 2005

(65) Prior Publication Data

US 2005/0168966 A1 Aug. 4, 2005

Related U.S. Application Data

(63) Continuation of application No. 10/320,472, filed on Dec. 17, 2002.

(30) Foreign Application Priority Data

Dec. 21, 2001 (JP) ..... 2001-390495
Apr. 12, 2002 (JP) ..... 2002-111069

(51) Int. Cl.
*H01H 9/00* (2006.01)

(52) U.S. Cl. ..... 200/310; 200/314

(58) Field of Classification Search ..... 200/310–314, 200/341–345, 329–331, 5 A, 510–520, 61.02
See application file for complete search history.

(56) References Cited

U.S. PATENT DOCUMENTS 4,051,210 A 9/1977 Wallenberger
4,278,861 A 7/1981 Matsuzaki
4,301,343 A 11/1981 Jonelis (Continued)

FOREIGN PATENT DOCUMENTS

JP 11-306900 A-1 11/1999

OTHER PUBLICATIONS

Chinese Patent Office, Office Action issued on Aug. 4, 2004.

*Primary Examiner*—Michael Friedhofer
*Assistant Examiner*—Lisa Klaus
(74) *Attorney, Agent, or Firm*—Rader, Fishman & Grauer PLLC

(57) ABSTRACT

An illuminated pushbutton switch cover member has a key seat and a resin key top. An indicator portion provided in the resin key top is illuminated with light from an internal light source provided below the key seat, and the light is emitted from the inside to the outside of the cover member through the indicator portion. The cover member is constructed by joining the resin key top to the key seat. The key seat is formed of a thermoplastic elastomer that prevents leakage of light, and an opening for passage of light is formed in the key seat to expose the bottom side of the resin key top to the internal light source. Thus, light from the internal light source can reach the bottom side of the resin key top directly without being attenuated. The indicator portion of the resin key top can therefore be illuminated with high luminance.

11 Claims, 7 Drawing Sheets

U.S. PATENT DOCUMENTS 4,473,729 A 9/1984 Ting et al.
4,798,690 A 1/1989 Levy
4,885,443 A 12/1989 Simcoe et al.
5,120,920 A 6/1992 Moriike
5,168,385 A 12/1992 Kobayashi et al.
5,401,927 A 3/1995 Lundell et al.
5,520,410 A 5/1996 Sun
5,807,002 A 9/1998 Tsai
5,860,540 A 1/1999 Bock
5,873,454 A 2/1999 Nakamura
5,888,656 A 3/1999 Suzuki et al.
5,911,317 A 6/1999 Tsai
5,931,474 A 8/1999 Chang et al.
6,023,860 A 2/2000 McMullin
6,068,416 A 5/2000 Kumamoto et al.
6,085,788 A 7/2000 Larson et al.
6,278,072 B1 8/2001 Nakajo
6,303,887 B1 10/2001 Ando
6,305,104 B1 10/2001 McMullin
6,325,194 B1 12/2001 Thomire
6,333,860 B1 12/2001 Oliphant et al.
6,357,634 B1 3/2002 Evans et al.
6,382,855 B1 5/2002 Katori
6,453,807 B1 9/2002 Ramey
6,542,353 B1 4/2003 Ardrey et al.
6,576,856 B1 6/2003 Masaru et al.
6,580,043 B1 6/2003 Spratte
6,589,470 B1 7/2003 Fried et al.
6,669,802 B1 12/2003 Andrews et al.
6,679,375 B1 1/2004 Coory

COVER MEMBER FOR ILLUMINATED PUSHBUTTON SWITCH

BACKGROUND OF THE INVENTION

This is a continuation application Ser. No. 10/320,472, filed on Dec. 17, 2002, the entire contents of which are hereby incorporated by reference.

FIELD OF THE INVENTION

The present invention relates generally to pushbutton switches, and in particular, to a cover member for an illuminated pushbutton switch having an illumination function for emitting light from the inside to the outside for use with pushbutton switches requiring input operations in a dark place, such as various switches for telephone, AV apparatuses, remote controllers, vehicle interior equipment, and so forth.

DESCRIPTION OF THE RELATED ART

Illuminated-type pushbutton switches are frequently used for switches requiring input operations in dark places, such as various switches for electronic equipment such as portable telephones and AV apparatuses, and vehicle interior equipment mounted on the vehicle, and so forth. Such illuminated-type switches have a key top with an indicator portion in which a letter, a numeric character, a symbol, a pattern or the like is formed, and through which light from an internal light source such as an LED is emitted. This type of switch is designed to enable an operator to easily recognize such an indication symbol and to provide input for an apparatus with reliability during the night or in dark places.

FIGS. 7A, 7B, and 8 show an example of a conventional illuminated pushbutton switch. A cover member 1 for this illuminated pushbutton switch is an example of a four-direction key designed to enable independent input operations at different positions. The structure of this illuminated pushbutton switch cover member 1 will be described. The cover member 1 is constructed by a solid resin key top 2 made of a transparent hard resin, such as polypropylene. The key top 2 is bonded and fixed to a key sheet 3 formed of a transparent silicone rubber. On the resin key top 2 are formed a transparent layer 4, a light-blocking indication layer 5 in which indicator portions 5*b* are formed as triangular symbols 5*a* in a blanking manner for indication of four directions, and a colorless transparent protective layer 6. The resin key top 2 is bonded and fixed to a key top supporting portion 3*a* of the key sheet 3. The key top supporting portion 3*a* has pressing projections 3*b* formed just below the triangular symbols 5*a*. A contact 3*c* formed from an electroconductive ink or the like is provided on an end of each pressing projection 3*b*.

To perform a switch function, the contact 3*c* is brought into contact with a contact Pc on a printed circuit board P (hereinafter referred to as "circuit board") mounted in a case C of an apparatus. The key sheet 3 has a flexible skirt portion 3*d* extending from the entire periphery of the key top supporting portion 3*a* obliquely downwardly so as to broaden toward the end. When an operator presses the resin key top 2, this thin skirt portion 3*d* is flexed so that the operator feels a click. The key sheet 3 has a base portion 3*e* formed at the lower peripheral end of the skirt portion 3*d*. The base portion 3*e* is placed on the circuit board P.

Referring to FIG. 8, in the illuminated pushbutton switch cover member 1 constructed as described above, light emitted from a light source PL provided on the circuit board P passes through the transparent key sheet 3 and the resin key top 2, is diffused by the transparent layer 4, and passes through the transparent protective layer 6 while internally illuminating the triangular symbols 5*a* formed in the indicator portions 5*b*. This is the illumination mechanism of the conventional pushbutton switch cover member 1.

The above-described conventional illuminated pushbutton switch cover member 1 has a certain effect of illumination of the triangular symbols 5*a* formed in the indicator portions 5*b*, but has a problem in that the intensity of light for illumination is low. That is, in this illuminated pushbutton switch cover member 1, the transparency of each of the key sheet 3 and the resin key top 2 is set substantially high in order that each triangular symbol 5*a* be illuminated as a clear indication at a high luminance. In this illuminated pushbutton switch cover member 1, however, a considerable amount of light leaks to the interior of the case C through the transparent key sheet 3 and the resin key top 2 (see FIG. 8). Therefore, light is also emitted to the outside through a gap Cd between a case surface defining a window hole Ch formed in the case C and the peripheral surface of the resin key top 2 (indication layer 5). This emission of light lowers the contrast of the illumination in the triangular symbols 5*a* with surrounding portion to reduce the apparent sharpness of the indication.

As a method for solving this problem a method of improving the combination of the pushbutton switch cover member 1 and the circuit board P, for example, by changing the position of the light source PL from the circuit board P to a place in the pushbutton switch cover member 1, and a method improving only the pushbutton switch cover member 1, are conceivable. In view of the manufacturing cost and the like, the method of improving only the pushbutton switch cover member 1 for solution of the problem is preferred. For example, as a method of improving only the pushbutton switch cover member 1 for solution of the problem, a method of coloring the key sheet 3 or a method of additionally forming a light-blocking layer on the skirt portion 3*d* of the key sheet 3 to prevent transmission of light through the corresponding portion of the key sheet 3 may be considered.

The method of coloring the key sheet 3, however, requires a secondary vulcanization process after kneading and forming silicone rubber, i.e., the material of the key sheet 3, and therefore entails the drawback of increasing the manufacturing cost. This method also entails a problem in that a low-molecular-weight siloxane component remaining in silicone rubber is scattered to cause a continuity fault or the like in the switch. On the other hand, the method of additionally forming a light-blocking layer has the drawback of increasing the number of process steps and is disadvantageous in terms of manufacturing time and cost.

While the state of the related conventional art is as described above, the miniaturization of illuminated pushbutton switches and the diversification of illuminated pushbutton switches accompanying the development of apparatuses having an increased number of functions have been advanced to meet market needs. Therefore there is a demand for further meticulous designs. If indicator portions including display of characters, numeric characters, symbols, and so forth, formed in an indication layer are designed more meticulously, and if a need arises to enable visual recognition of details of such indicator portions, it is necessary to increase the intensity of light for illumination in order to improve the visibility of details of such indicator portions, and it is also necessary to realize higher illumination at a low cost.

SUMMARY OF THE INVENTION

An illuminated pushbutton switch cover member in accordance with the present invention has been made under these circumstances. That is, an object of the present invention is to provide an illuminated pushbutton switch cover member which is capable of illumination at a higher luminance and which can be produced at a low cost.

To achieve the above-described object, according to the present invention, there is provided an illuminated pushbutton switch cover member which has a key sheet and a resin key top mounted on and jointed to the key sheet, and in which an indicator portion provided in the resin key top emits light from inside upon receiving light from an internal light source provided below the key sheet. The pushbutton switch cover member is characterized in that the key sheet is formed of a thermoplastic elastomer capable of blocking light, and in that an opening for passage of light is formed in the key sheet to expose the bottom side of the resin key top to the internal light source.

In this illuminated pusbutton switch cover member, the key sheet is made of a thermoplastic elastomer capable of blocking light and has an opening for passage of light formed therein so that the bottom side of the resin key top is exposed to the internal light source. Leakage of light through the key sheet is thereby prevented. Also, light from the internal light source is not transmitted through the key sheet portion as in the conventional cover member and can reach the bottom side of the resin key top directly without being attenuated. The resin key top can thus be illuminated at a luminance increased by an amount corresponding to the attenuation of light avoided by the key sheet. By using a conventional circuit board in combination with the above-described structure, a pushbutton switch having a high-luminance indicator portion can be obtained easily at a low cost.

The present invention is also characterized in that the resin key top is provided as a member capable of blocking light by forming a light-blocking layer covering the transparent resin key top, or by forming the resin key top from a resin capable of blocking light. In this pushbutton switch cover member, while the indicator portion provided in the resin key top is illuminated, the portion of the resin key top other than the indicator portion blocks light and is not illuminated, so that the luminance at which the indicator portion is illuminated is not relatively reduced due to leakage of light through any portion of the resin key top other than the indicator portion, thus improving the visibility of the indicator portion. The indicator portion is a portion indicating the shape of a letter, a symbol, or the like, and may be in a die-cut shape or a shape molded into the resin key top.

According to the present invention, there is also provided an illuminated pushbutton switch cover member which is formed in a hat-like shape as viewed in section such that a resin key top has a top-side portion and a peripheral-side portion extending from the peripheral end of the top side portion and has a cavity surrounded by these portions. In this pushbutton switch cover member, light passes through the cavity, and the attenuation of light is therefore reduced in comparison with the case where light passes through a resin, so that the luminance at which an indicator portion is illuminated is increased. This construction also contributes to a reduction in raw material cost.

The shape of the opening end of the resin key top at the cavity formed therein is opened and coincides substantially with the shape of the opening end of the opening formed in the key sheet for passage of light. Since the shape of the opening end of the resin key top and the shape of the opening end of the key sheet opening for passage of light coincide substantially with each other, light from the light source can reach the back surfaces of the topside and peripheral-side portions of the resin key top without being blocked by the key sheet, so that an indicator portion provided in the key top is illuminated at a high luminance level. Also, since light can reach a wide area on the back surface of the resin key top, the indicator portion can be illuminated at a high luminance regardless of the position where the indicator portion is provided in the top-side portion or the peripheral-side portion.

According to the present invention, there is also provided an illuminated pushbutton switch cover member in which a key sheet capable of blocking light is formed by forming a key sheet member of a thermoplastic elastomer capable of blocking light or by forming a light-blocking layer on a key sheet member. Since the key sheet portion can block light, leakage of light to the outside through the key sheet portion can be prevented. It is therefore possible to prevent a reduction in apparent luminance of illumination caused by leakage of light through a portion other than the indicator portion. If the key sheet is formed by using a thermoplastic elastomer capable blocking light, there is no need to additionally provide a light-blocking layer, thereby reducing the number of process steps and the manufacturing cost.

According to the present invention, there is further provided an illuminated pushbutton switch cover member in which a resin key top has a flange portion extending outward, and a cover portion for covering the flange portion is provided on a key sheet. When this pushbutton switch cover member is set in a case of an apparatus by being inserted in a hole formed in the case, the flange portion provided on the resin key top abuts the inside of the case against an edge portion of a hole formed in the case through which the resin key top is inserted, and is caught by this portion, thereby preventing the resin key top from coming off the case. The flange portion having this function is covered with the cover portion of the key sheet to prevent leakage of light through the flange portion.

According to the present invention, there is further provided an illuminated pushbutton switch cover member in which a key sheet includes: a key top supporting portion having a portion to be jointed to a resin key top and an opening for passage of light; a base portion placed on a circuit board; and a skirt portion connecting the key top supporting portion and the base portion, which is thin and flexible and broadens toward its end. The pushbutton switch cover member has the skirt portion which is thin and flexible and which broadens toward its end, and therefore performs the function of giving a click feeling required as one of the functions of the pushbutton switch cover member. The skirt portion at which leakage of light may occur easily is blocked from light, thereby ensuring an increased luminance in illumination.

The pressing projection for pressing against a contact on a circuit board is formed on the back side of a portion of a key sheet joined to a resin key top. Since the pressing projection for pressing against a contact on a circuit board is formed on the back side of the surface of the key sheet joined to the resin key top, a pressing force applied to the resin key top is directly transmitted to the pressing projection, so that the pressing force applied to the resin key top can be utilized efficiently for on/off operation, thus improving the operability of the pushbutton switch cover member.

According to the present invention, there is further provided an illuminated pushbutton switch cover member in which a key top a key sheet are integrally combined by being welded to each other. In this pushbutton switch cover member, since no adhesive is used for bonding between the key top and the key sheet, there is no need for a bonding step using an adhesive in the manufacturing process. The key sheet can be bonded to the key top in an injection molding step for forming the key sheet from a thermoplastic elastomer, thus reducing the number of process steps and the manufacturing cost.

In the above-described pushbutton switch cover members of the present invention, it is preferable to form an indicator portion in the light-blocking layer with which the resin key top is covered, and further to provide a resin film as a protective layer covering the light-blocking layer. The resin film having higher wear resistance prevents damage to or a break in the light-blocking layer and, hence, leakage of the light from the internal light source through. the damaged light-blocking layer.

The details of the present invention are not limited to the contents of the above description. These and other objects, advantages, features and use of the present invention will become apparent from the following description with reference to the accompanying drawings. It is to be construed that various changes suitably made in implementing the present invention without departing from the spirit of the present invention are included in the scope of the present invention.

BRIEF DESCRIPTION OF THE DRAWINGS

The present invention will become more clearly appreciated as the disclosure of the invention is made with reference to the accompanying drawings. In the drawings.

DETAILED DESCRIPTION OF THE PREFERRED EMBODIMENTS

Figure 1A:
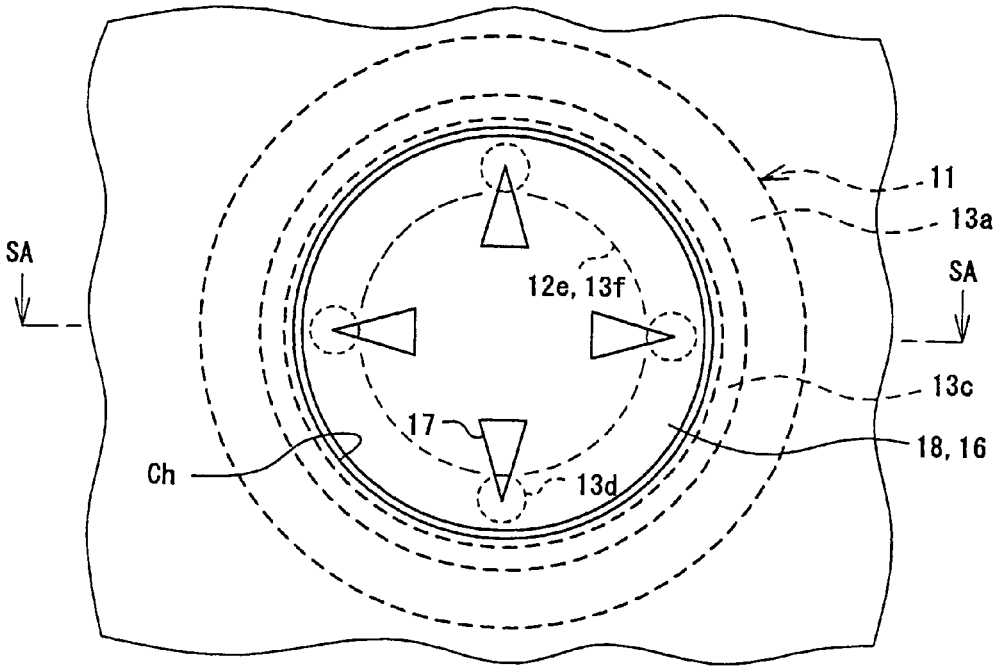
FIG. 1A is a plan view of a pushbutton switch having a pushbutton switch cover member according to a first embodiment of the present invention.

Embodiments of the present invention will be described with reference to the accompanying drawings. Common members or portions of the embodiments are indicated by the same reference characters, and the description for the same portions will not be repeated.

First Embodiment

Figure 1B:
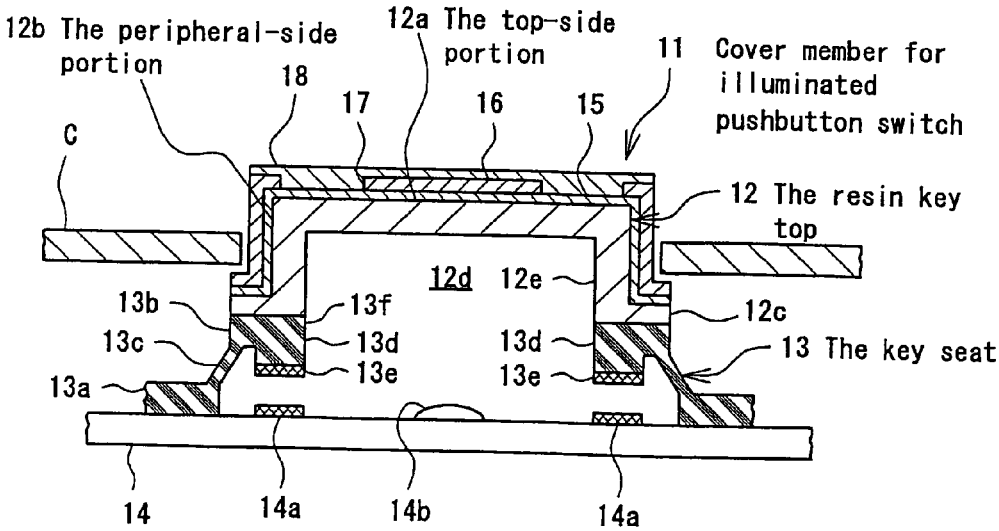
FIG. 1B is a cross-sectional view taken along the line SA—SA in FIG. 1A.
Figure 2:
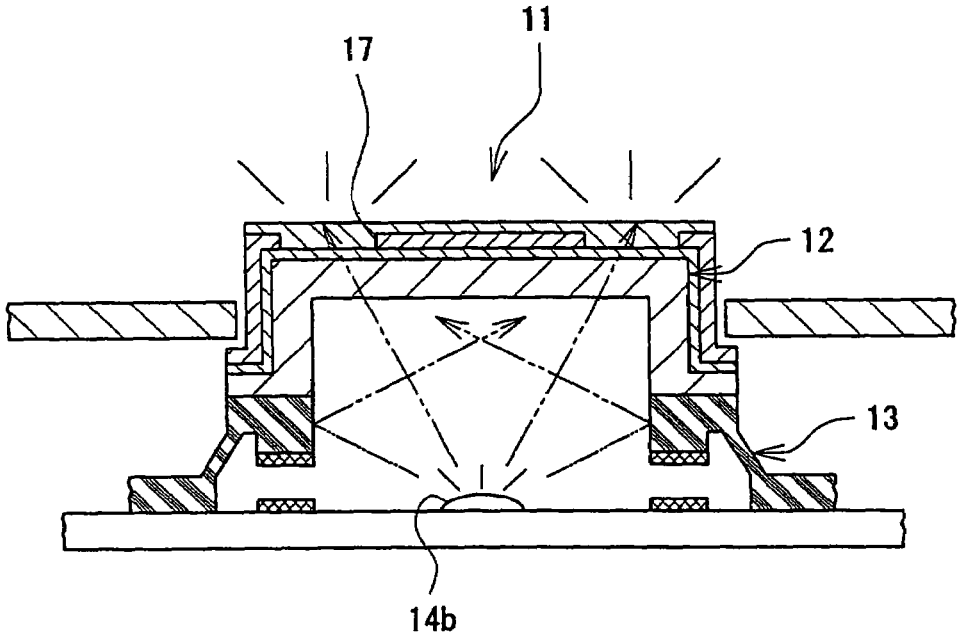
FIG. 2 is a diagram showing an illuminated state of the pushbutton switch cover member shown in FIGS. 1A and 1B.

A first embodiment will be described with reference to FIGS. 1A, 1B, and 2 of the drawings. A cover member 11 for an illuminated pushbutton switch according to this embodiment has, as shown in FIG. 1B, a resin key top 12 made of a transparent resin, and a light-blocking key sheet 13 made of a rubber-like elastic material. The resin key top 12 and the light-blocking key sheet 13, combined integrally with each other, and a circuit board 14 on which other switch devices (not shown) are mounted, constitute a pushbutton switch.

The resin key top 12 has a flat disk-like top-side portion 12*a*, a cylindrical peripheral-side portion 12*b* extending downward from the peripheral end of the top-side portion 12*a*, and an annular flange portion 12*c* extending outwardly from a lower end portion of the peripheral-side portion 12*b*. The entire resin key top 12 is generally in a hat-like form with a cavity 12*d* formed thereon. The resin key top 12 is formed by injection molding of a transparent hard resin.

The resin used to form the resin key top 12 may be a thermosetting resin or a thermoplastic resin as long as it has light transmittance. Examples of the thermoplastic resins available as the material of the resin key top 12 are a polyethylene resin, a polypropylene resin, a polyvinyl chloride resin, an acrylonitrile-butadiene-styrene resin, an acrylyonitrile-styrene-acrylate resin, a polyamide reside, a polyacetal resin, a polycarbonate resin, a polyethylene terephthalate resin, a polybutylene terephthalate resin, a polyphenylene oxide resin, a polyphenylene sulfide resin, a polyurethane resin, a polyhenylene ether resin, a denatured polyphenylene ether resin, a silicone resin, a polyketone resin, a liquid crystal polymer, and a composite material formed of some of these resins. Examples of available thermosetting resins are a phenolic resin, an epoxy resin, a silicone resin, a polyurethane resin, a melamine resin, an unsaturated polyester resin, and a composite material formed of some of these resins. Among the above-described resins, a polyporpylene resin, a polyacetal resin, a polybutylene terephthalate resin, an acrylonitrile-butadiene-styrene resin and a polycarbonate resin are preferred because they have satisfactory moldability and can be molded comparatively easily in a comparatively short molding cycle, and because molded articles obtained from them have a good surface condition and good processability with respect to processing (coating, printing, plating, deposition, and so forth) for an ornamental effect after molding. Further, among these resins, a polycarbonate resin is particularly preferred because it has satisfactory bondability to a thermoplastic ester elastomer and is superior in resin transparency, heat resistance (having a high load-deflection temperature and resistance to thermal degradation), cold resistance, weather resistance, impact resistance and post-processability.

A transparent layer 15 is formed on the surface of the resin key top 12. The transparent layer 15 has the function of diffusing light from an internal light source 14*b* provided below the pushbutton switch cover member 11. The transparent layer 15 may be colorless or colored if it can diffuse light. As the material of the transparent layer 15, a material having high adhesion to the resin key top 12 is preferred. The transparent layer 15 is formed by printing or coating, for example.

A light-blocking layer 16 is formed on the transparent layer 15. The light-blocking layer 16 is required to prevent light from leaking out through the portion of the resin key top 12 other than indicator portions 17. The light-blocking layer 16 may be formed by printing, coating, deposition, transfer by hot stamping, plating or some other method. It is necessary that the thickness of the light-blocking layer 16 be large enough to block light from the back side.

the indicator portions 17 indicating letters, numeric characters, symbols or a pattern are formed into shapes corresponding to letters or the like by cutting the light-blocking layer 16, for example, by laser marker trimming so that the lower transparent layer 15 is exposed. Light passing through the resin key top 12 is blocked by the lock-blocking layer 16. However, part of the light emerges from the indicator portions 17, thus illuminating the indicator portions 17 of the resin key top 12.

A protective layer 18 is formed over the indicator portions 17 to prevent the indicator portions 17 and the light-blocking layer 16 from being worn away. To form the protective layer 18, a transparent material having sufficiently high wear resistance is selected.

The key sheet 13 is constituted by a base portion 13*a* positioned and mounted on the circuit board 14, a key top supporting portion 13*b* through which the key sheet 13 is joined to the resin key top 12, and a skirt portion 13*c* which is thin and flexible and which extends from the key top supporting portion 13*b* obliquely downwardly so as to broaden toward the end and connect to the base portion 13*a*. Pressing projections 13*d* are formed on the back side of the key top supporting portion 13*b*, and contacts 13*e* are formed on lower ends of the pressing projections 13*d*, for example, by using an electroconductive ink. The contacts 13*e* are opposed to contacts 14*a* provided on the circuit board 14. To do key input, the resin key top 12 is depressed so that one of the contacts 13*e* is brought into contact with the corresponding one of the contacts 14*a*. The key top supporting portion 13*b* is provided above the base portion 13*a* with the skirt portion 13*c* provided therebetween and has an annular horizontal cross section forming an opening 13*f* for passage of light.

To form this key sheet 13, a rubber-like elastic material capable of blocking light, for example, a thermoplastic elastomer, is used. Examples of materials available as the material of the key sheet 13 are a thermoplastic styrene elastomer, a thermoplastic olefin elastomer, a thermoplastic polyester elastomer, a thermoplastic polyurethane elastomer, a thermoplastic polyamide elastomer, and a thermoplastic polyvinyl chloride elastomer. Among these materials, a thermoplastic polyester elastomer, a thermoplastic styrene elastomer, a thermoplastic polyurethane elastomer, and a thermoplastic olefin elastomer are preferred from the viewpoint of moldability after coloring, load characteristics, click feeling, and bondability to the resin. A thermoplastic polyester elastomer is particularly preferred because it is excellent in impact resilience (highest among thermoplastic elastomers) and satisfactory in heat resistance, operating durability, and solvent resistance. The hardness of the thermoplastic elastomer selected for a suitable click feeling is, preferably, 50 to 90 degrees and, more preferably, 60 to 80 degrees as measured with a durometer in accordance with JIS-K 6253 type A. If the hardness is lower than 50 degrees, the key sheet 13 is too flexible to give a good click feeling and is lower in durability. If hardness exceeds 90 degrees, the operation resistance is so high that the switch cannot be easily depressed.

In joining the resin key top 12 and the key sheet 13, the peripheral-side portion 12*b* and the flange portion 12*c* of the resin key top 12 are jointed to the key top supporting portion 13*b* of the key sheet 13. The opening diameter of the inner circumferential surface 12*e* of the peripheral-side portion 12*b* and the opening diameter of the opening 13*f* for passage of light of the key top supporting portion 13*b* are set substantially equal to each other. The inner circumferential surface 12*e* and the surface defining the opening 13*f* for passage of light, which are generally flush with each other, form a cylindrical large cavity inside the resin key top 12 and the key sheet 13 in the state of being joined to each other as described above.

The functions and the effects of this embodiment will be described.

In the pushbutton switch cover member 11 according to this embodiment, the key top supporting portion 13*b* of the key sheet 13 jointed to the resin key top 12 forms the circular opening 13*f* for passage of light, and the diameter of this opening 13*f* and the diameter of the inner circumferential surface 12*e* of the peripheral-side portion 12*b* of the resin key top 12 are substantially equally to each other. Therefore, light emitted from the internal light source 14*b* can reach the resin key top 12 without being blocked by the key sheet 13 or other internal structure portions. Further, the resin key top 12 has the cavity 12*d* formed therein so that it is generally in a hat form as viewed in a section. The thickness of the portion of the resin key top 12 through which light is transmitted is thus reduced to thereby minimize the attenuation of light and to enable the indicator portions 17 in the resin key top 12 to be illuminated at a high luminance.

Since the light-blocking layer 16 is formed in the resin key top 12 made of a transparent resin, light does not leak through any portion other than the indicator portions 17 in the resin key top 12. Also, since the key sheet 13 is made of a thermoplastic elastomer capable of blocking light, light does not through the key sheet 13. Therefore, light for illumination of the indicator portions 17 is not reduced, so that the visibility of the indication is improved.

The joint surfaces of the resin key top 12 and the key sheet 13 are formed and jointed to each other in such a manner that the key sheet 13 is heat welded to the resin key top 12 by being injection molded on the resin key top 12 into a predetermined shape. Use of an adhesive can therefore be avoided, so that the work and cost can be reduced. In the conventional art, since silicone rubber is used to form the key sheet, a bridging step is required after molding, and it is difficult to bond the members by heat welding at the time of injection molding. In contrast, in this embodiment of the present invention, a thermoplastic elastomer is used as the material of the key sheet 13 to enable welding. If the resin key top 12 is formed with no cavity, and if the key sheet 13 is formed with no opening for passage of light, the area of the joint between the resin key top and the key sheet can be increased and the possibility of the resin key top separating and coming off is not a consideration. On the other hand, in a case where a large cavity 12*d* is formed in the resin key top 12, and a corresponding large opening 13*f* for passage of light is formed in the key sheet 13 for the pursuit of higher luminance, the area of the joint between the resin key top 12 and the key sheet 13 is reduced and a problem arises in that the resin key top 12 may separate and come off.

However, if a polycarbonate resin is used to form the resin key top 12, and if a resin formed of a thermoplastic polyester elastomer is used to form the key sheet 13, the strength of bonding by heat welding is markedly high and there is no problem caused by the possibility of separation of the resin key top 12 from the key sheet 13. Therefore, a combination of such a resin and a thermoplastic elastomer is preferably used in a realizable arrangement for higher luminance according to this embodiment using the large cavity 12*d* and the large opening 13*f* for passage of light.

The pressing projections 13*d* for pressing the contacts 13*e* against the contacts 14*a* on the circuit board 14 are provided just below the key top supporting portion 13*b* joined to the peripheral-side portion 12*b* of the resin key top 12. Therefore, when the resin key top 12 is pressed, a pressing force is immediately applied to one of the pressing projections 13*d* through the key top supporting portion 13*b*, thus performing the on/off function of the switch with reliability.

Second Embodiment

Figure 3A:
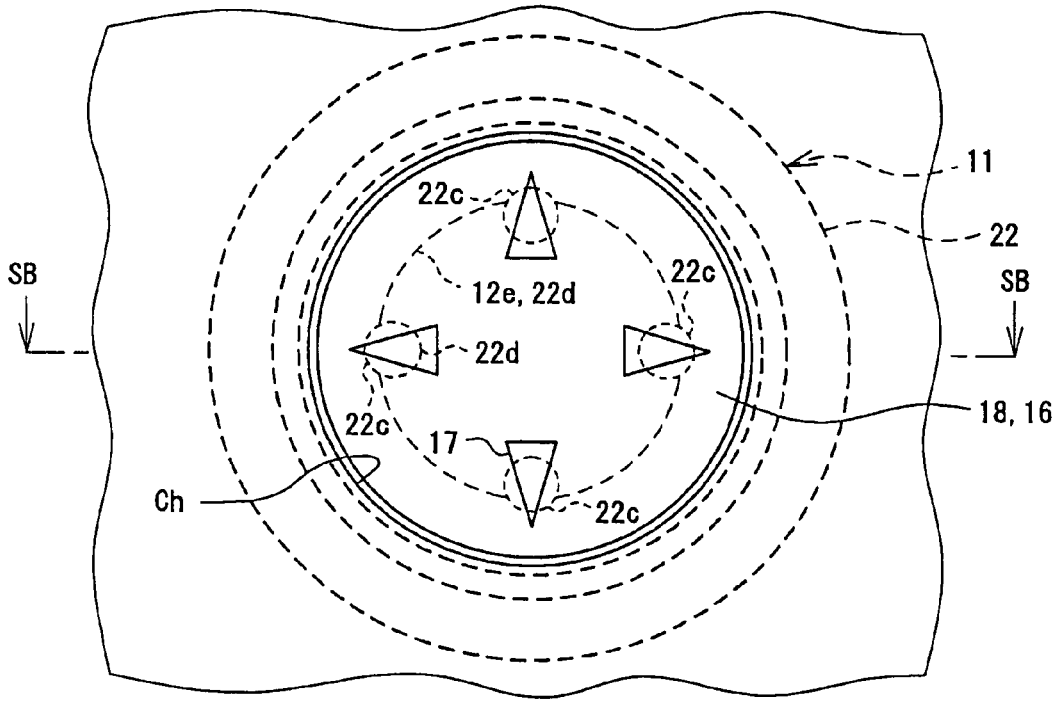
FIG. 3A is a plan view of a pushbutton switch having a pushbutton switch cover member according to a second embodiment of the present invention.
Figure 3B:
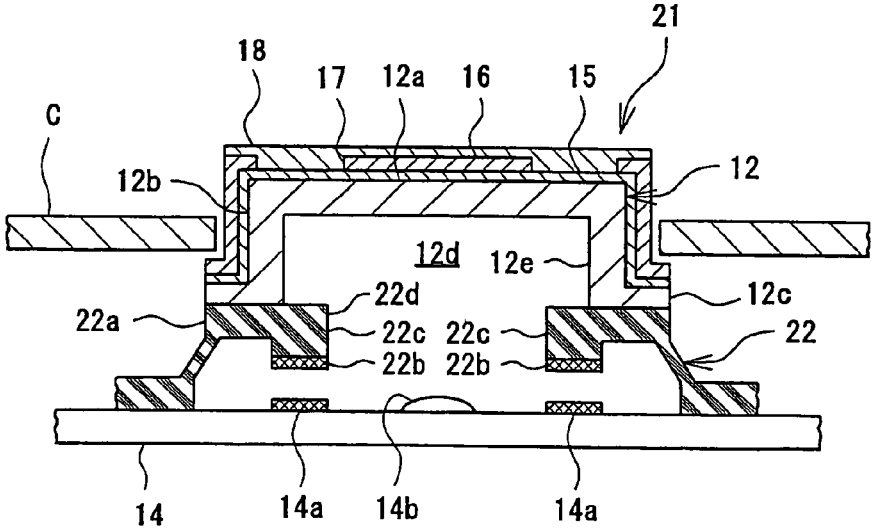
FIG. 3B is a cross-sectional view taken along the line SB—SB in FIG. 3A.
Figure 4:
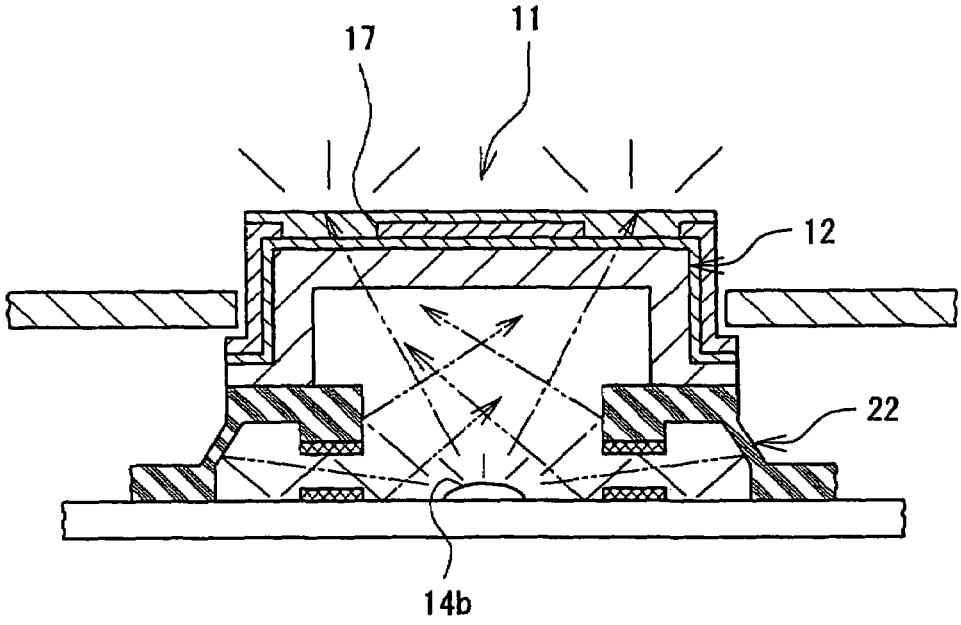
FIG. 4 is a diagram showing an illuminated state of the pushbutton switch cover member shown in FIGS. 3A and 3B.

A second embodiment of the present invention will now be described with reference to FIGS. 3A, 3B, and 4 of the drawings. In the second embodiment, the pushbutton switch cover member 11 of the first embodiment is modified to obtain a pushbutton switch over member 21, as shown in FIGS. 3A, 3B, and 4. The pushbutton switch cover member 21 of this second embodiment differs from the cover member 11 of the first embodiment only in the structure of a key sheet 22, and is the same as the cover member 11 in other respects.

Four pressing projections 22*c* having contacts 22*b* attached to their ends are also formed on a key top supporting portion 22*a* of the key sheet 22. In the structure of this key sheet 22, however, each pressing projection 22*c* projects inwardly in an opening 22*d* for passage of light. In this projection structure, light to be projected to the peripheral-side portion 12*b* of the resin key top 12 is partly blocked by the pressing projections 22*c*. The indicator portions 17 may be formed by being increased in size to such an extent that portions of the circuit board 14 can be seen through the indicator portions 17 to considerably impair the appearance of the switch. In such a case, it is desirable that the pressing projections 22*c* in the projection structure function as a screen to hide the internal portions.

The structure of the key sheet 22 may be further modified in such a manner that not only the pressing projections 22*c* but also the opening 22*d* for passage of light is changed so as to reduce the diameter thereof relative to the opening diameter of the inner circumferential surface 12*e* of the resin key top 12, that is, the entire inner circumference of the opening 22*d* for passage of light is inwardly extended to increase the amount of screening.

Third Embodiment

Figure 5:
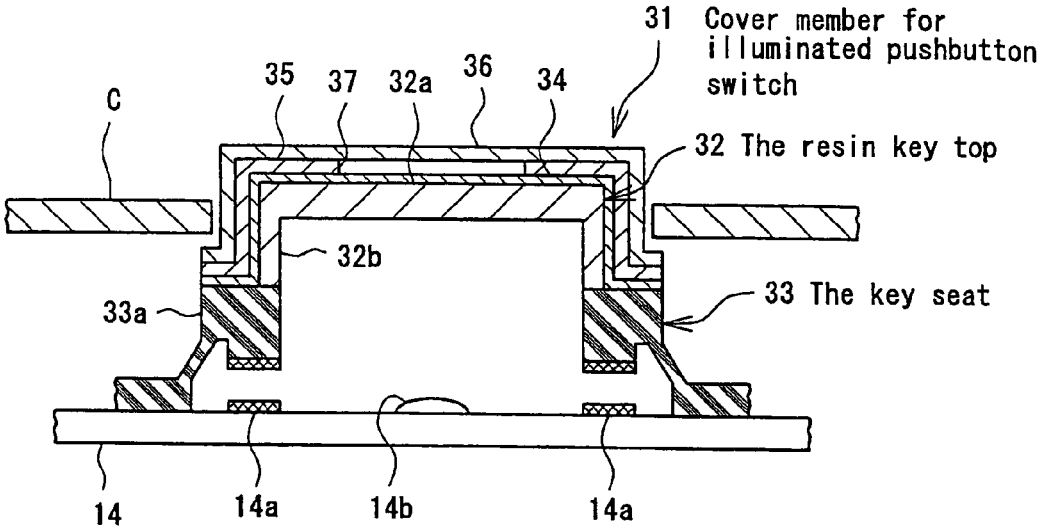
FIG. 5 is a cross-sectional view of a pushbutton switch having a pushbutton switch cover member according to a third embodiment of the present invention.

A third embodiment of the present invention will now be described with reference to FIG. 5 of the drawings. In the third embodiment, a pushbutton switch cover member 31 has a transparent resin key top 32 and a key sheet 33 formed as shown in FIG. 5. The thickness of the key top supporting portion 33*a* of the key sheet 33 in this embodiment is larger than that in the first embodiment. The structure of the key sheet 33 is the same as that in the first embodiment in other respects.

The resin key top 32 has a top-side portion 32*a* and a peripheral-side portion 32*b* but has no flange portion corresponding to the flange portion 12*c* in the hat-like sectional configuration in the above-described embodiments. The thickness of the key top supporting portion 33*a* is increased as described above by the amount corresponding to the thickness of the flange portion removed. Also, leakage of light through the flange portion is prevented by removing the flange portion, thus achieving a complete blockage of light leakage. A transparent layer 34, a light-blocking layer 35 and a protective layer 36 formed of a transparent resin film are formed in this order on the resin key top 32. As the materials of the transparent layer 34 and the light-blocking layer 35, the same materials as those in the above-described embodiments can be used. Examples of materials available for the resin film forming the protective layer 36 are a polycarbonate resin, a polyethylene terephthalate resin, NYLON ( a registered trademark), a polyvinyl chloride resin, a polyimide resin, and an alloy film made of some of these resins.

To obtain the multilayer structure shown in FIG. 5, the light-blocking layer 35 and the transparent layer 34 are first formed on the protective layer 36, which is formed of a flat resin film. At this time, indicator portions 37 are formed by carving characters, numeric characters, symbols, figures or the like in the light blocking layer 35, or cutting the layer 35 in a blanking manner. After the light-blocking layer 35 and the transparent layer 34 are formed integrally with each other on the resin film (the protective layer 36), curvature forming is then performed by using forming dies having shapes corresponding to the shape of the resin key top 32. The member thus formed is inserted in a mold for injection molding, and a thermoplastic resin, such as a polycarbonate resin, is injected to form the resin key top 32. Thus, the multilayer structure is obtained in which the resin key top 32, the transparent layer 34, the light-blocking layer 35, and the protective layer 36 formed of a resin film are combined integrally with each other, as shown in FIG. 5.

The protective layer 36 is formed by using a resin film in this embodiment for reasons described below. To heat weld the key sheet 13 to the resin key top 12 by two-color molding in each of the above-described embodiments, it is necessary to insert in a mold for two-color molding the resin key top 12 in which the protective layer 18, the light-blocking layer 16, and the transparent layer 34 are formed one on another. At the time of this insert molding, there is a possibility of the edges of the protective layer 18 and the light-blocking layer 16 being damaged by the mold for insert molding. When the pushbutton switch cover member having a portion damaged and cut in this manner is illuminated from the back side, light leaks out through the damaged and cut portion. In such a case, the intended effect of improving the luminance in the indicator portion 37 is reduced and the appearance is impaired. Also, the yield is reduced and the manufacturing cost is increased.

Therefore, there is a need to ensure that the protective layer 18 and the light-blocking layer 16 are not easily damaged or cut in the process of two-color molding of the key sheet 12. In this embodiment, therefore, the structure using a resin film as the protective layer 36 is adopted. In addition to the above-described reason in terms of manufacture, there is also a reason in terms of practical use. That is, in the above-described embodiments, it is not possible to completely prevent wear in the protective layer 18 and the light-blocking layer 16 repeatedly subjected to pressing. Therefore, the protective layer 36 is formed as a resin film to improve the wear resistance.

Fourth Embodiment

Figure 6:
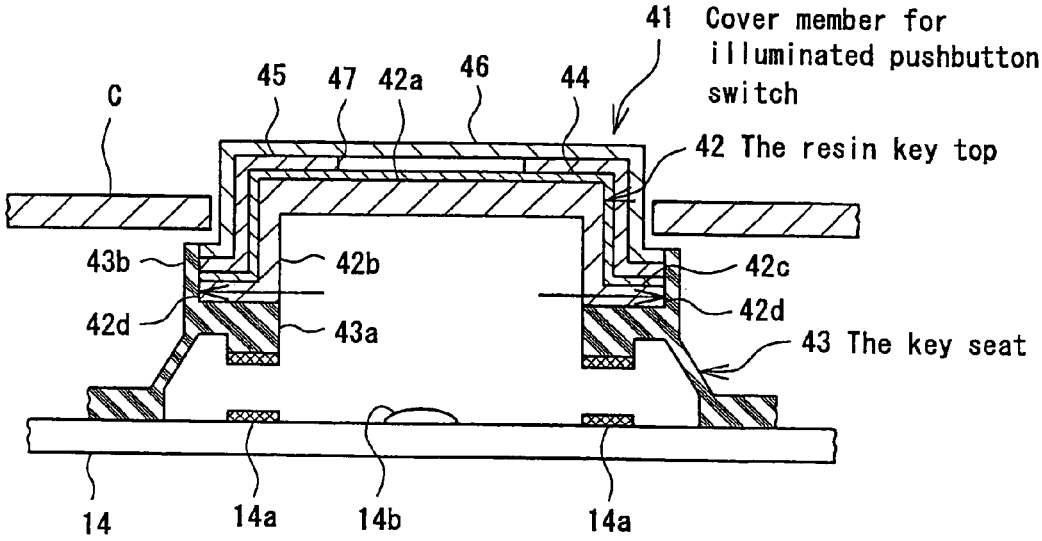
FIG. 6 is a cross-sectional view of a pushbutton switch having a pushbutton switch cover member according to a fourth embodiment of the present invention.
Figure 7A:
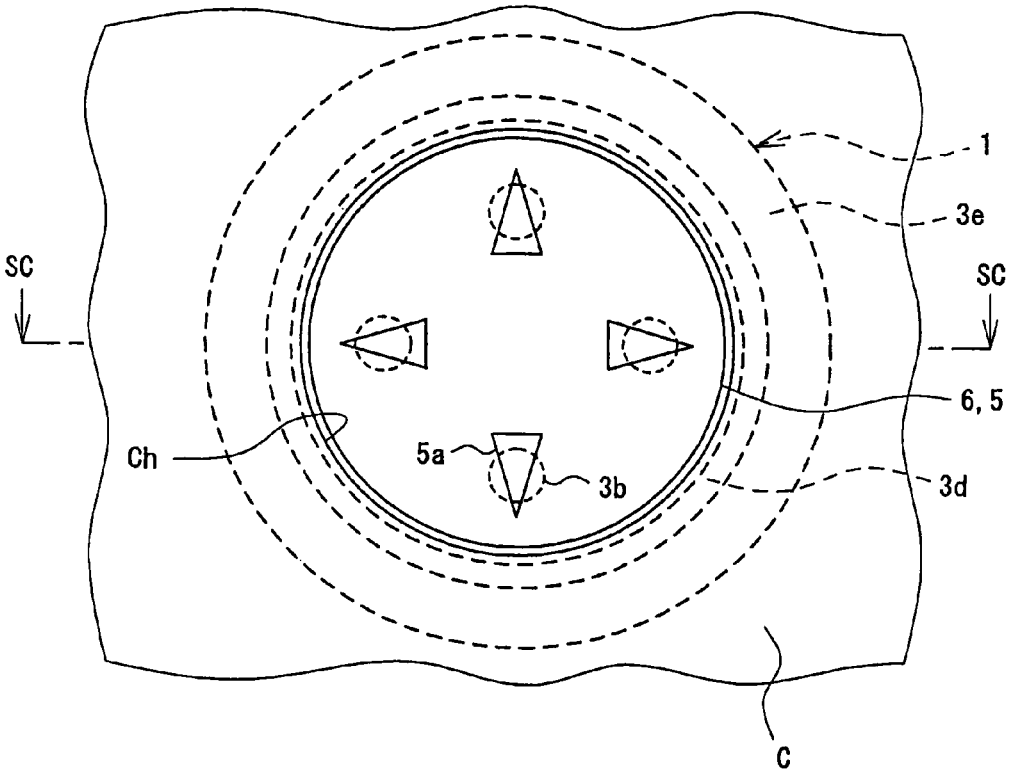
Fig. 7A (Prior Art)
FIG. 7A is a plan view of a pushbutton switch having a conventional pushbutton switch cover member.
Figure 7B:
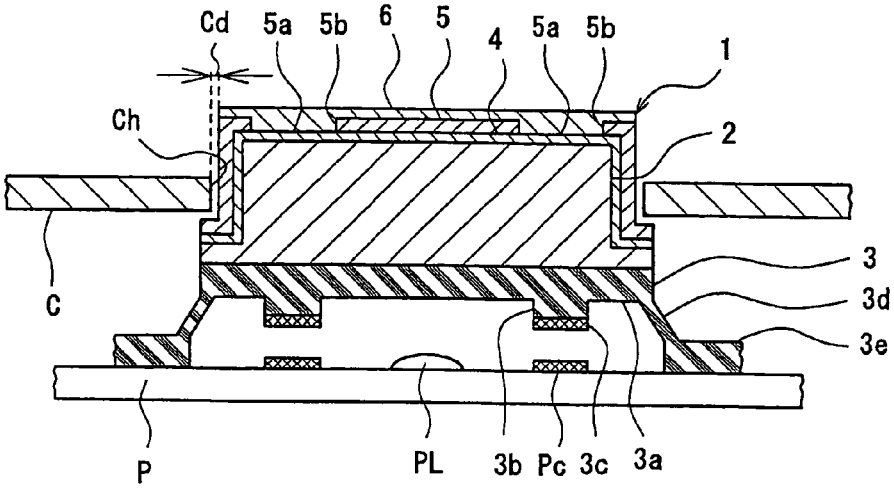
Fig. 7B (Prior Art)
FIG. 7B is a cross-sectional view taken along the line SC—SC in FIG. 7A.
Figure 8:
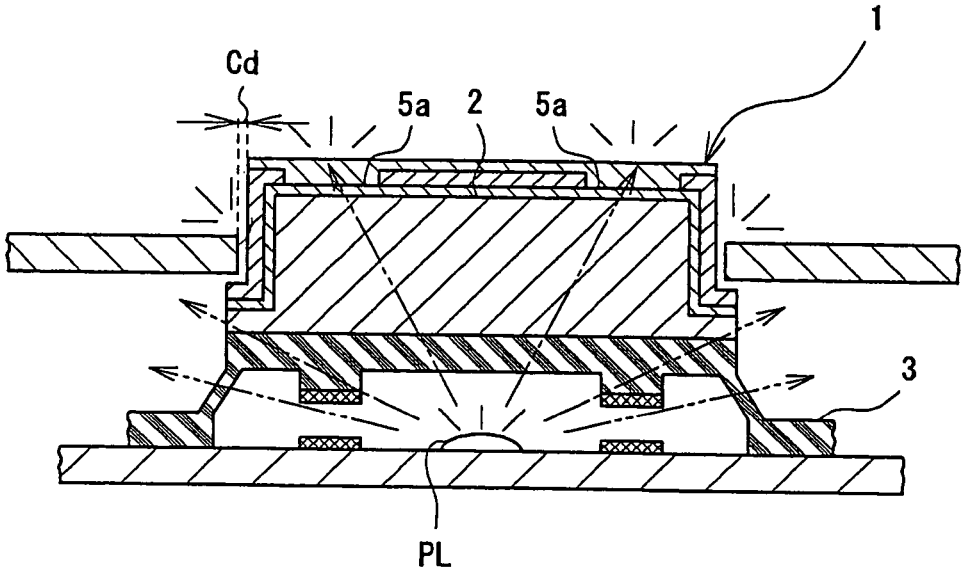
Fig. 8 (Prior Art)
FIG. 8 is a diagram showing an illuminated state of the pushbutton switch cover member shown in FIG. 7.

A fourth embodiment of the present invention will now be described with reference to FIG. 6 of the drawings. In the fourth embodiment, a pushbutton switch cover member 41 has a transparent resin key top 42 and a key sheet 43. The shape of the key top 42 and the construction of the key sheet 43 are different from those in the third embodiment. The method of forming a transparent layer 44, a light-blocking layer 45, and a protective layer 46 formed of a resin film on the resin key top 42 and the materials of the layers are the same as the method of forming the corresponding layers and the materials of the corresponding layers in the third embodiment.

In the resin key top 42 of this embodiment, a top-side portion 42*a*, a peripheral-side portion 42*b* and a flange portion 42*c* are formed the same as those corresponding portions in the first embodiment. The entire resin key top 42 is transparent. Therefore, if light from the internal light source 14*b* travels in the directions of the arrows indicated in FIG. 6, there is a possibility of the light leaking to the outside through the peripheral surface 42*d* of the transparent flange portion 42*c*. The amount of light leaking through this portion is small. However, this embodiment includes a cover portion 43*b* that covers the peripheral surface 42*d* of the flange portion 42*c*. The cover portion 43*b* is formed on a key top supporting portion 43*a* of the light-blocking key sheet 43 as a means for preventing a small light leak through the peripheral surface 42*d* of the flange portion 42*c*. In the pushbutton switch cover member 41 of this embodiment, leakage of light to the outside can be completely blocked to further increase the luminance at which the indicator portions 47 formed in the light-blocking layer 45 are illuminated, further improving the visibility of the indication.

Other Possible Modifications

If a resin capable of blocking light is used in place of the transparent resin for each of the resin key tops 12, 32 and 42 in the above-described embodiments, there is no need to additionally form the light-blocking layer 16, 35 and 45. In this case, portions of the resin key top 12, 32, or 42 in which letters, numeric characters, symbols or figures are to be formed, are cut in a blanking manner with a laser, for example, to enable light to pass therethrough to thereby form an indicator portion. In a case where a resin capable of blocking light is used to form the resin key top 12, 32, or 42, a transparent protective layer may be formed on the top-side portion 12*a*, 32*a*, or 42*a* and on the peripheral-side portion 12*b*, 32*b*, or 42*b*. Alternatively, the resin key top 12, 32, or 42 may be made by two-color molding of a resin capable of blocking light and a transparent resin.

In a case where a transparent thermoplastic elastomer for the key sheet 13, 22, 33, or 43 is used without using a light-blocking thermoplastic elastomer, a light-blocking layer may be additionally formed on the surface of the key sheet to prevent leakage of light to the outside through the key sheet.

While the embodiments have been described with respect to a case where four pressing projections 13*d* or 22*c* are provided in one pushbutton switch cover member 11 or 21 (not shown with respect to the third and fourth embodiments), two pressing projections for a so called seesaw key arrangement or only one pressing projection may alternatively be used.

In each of the above-described embodiments, the shape of the resin key top 12 as viewed in plan view is approximately circular (not shown with respect to the third and fourth embodiments). However, the shape of the resin key top is not limited to the circular shape and may be a rectangular shape or any other polygonal shape. In a case where the resin key top is formed in a rectangular shape, the skirt portion connecting to one peripheral side portion may be increased in thickness while the other skirt portions connected to the other three peripheral side portions are comparatively reduced in thickness, thereby enabling a pressing projection provided at the side opposite from the side adjacent to the thicker portion to be easily depressed.

INDUSTRIAL APPLICABILITY

In the pushbutton switch cover member according to the present invention, the key sheet is made of a thermoplastic elastomer capable of blocking light and has an opening for passage of light formed therein so that the bottom side of the resin key top is exposed to the internal light source. Leakage of light through the key sheet is thus prevented. Also, light from the internal light source is not transmitted through any portion of the key sheet, as in the conventional cover member, and can reach the bottom side of the resin key top directly without being attenuated. The resin key top can be illuminated at a luminance increased by an amount corresponding to the avoided attenuation of light by the key sheet. By using a conventional circuit board in combination with the above-described structure, a pushbutton switch having a high-luminance indicator portion can be obtained easily at a low cost.

In the pushbutton switch cover member according to the present invention, while the indicator portion provided in the resin key top is illuminated, the portion of the resin key top other than the indicator portion blocks light and is not illuminated. Therefore, the luminance at which the indicator portion is illuminated is not relatively reduced by leakage of light through any portion of the resin key top other than the indicator portion, thus improving the visibility of the indicator portion. Further, since light passes through the cavity, the attenuation of light is reduced in comparison with the case where light passes through a resin, so that the luminance at which the indicator portion is illuminated is increased and the raw material cost is reduced.

Also, the pushbutton switch cover member of the present invention as a skirt portion which is thin and flexible and which broadens toward its end. Therefore, the skirt portion functions to give a click feeling, which is required as one of the functions of the pushbutton switch cover member. The skirt portion at which leakage of light may occur easily is made capable of blocking light, thereby ensuring an increased luminance of the indicator portion.

While the invention has been specifically described in connection with specific embodiments thereof, it is to be understood that this is by way of illustration and not of limitation, and the scope of the appended claims should be construed as broadly as the prior art will permit.

What is claimed is:

1. An illuminated pushbutton switch cover member, comprising:

a key sheet capable of blocking light and formed of a thermoplastic elastomer; and a resin key top capable of blocking light and having a light-blocking layer that covers a portion of the resin key top other than an indicator portion, the indicator portion emitting light from inside upon receiving light from an internal light source provided below the key sheet;

wherein an opening for passage of light is formed in the key sheet to expose a bottom side of the resin key top to the internal light source, and wherein the resin key top and the key sheet are integrally combined by being welded to each other.

2. The illuminated pushbutton switch cover member according to claim 1 wherein a transparent layer is formed on the surface of the resin key top, said transparent layer having the function of diffusing light from an internal sight source.

3. The illuminated pushbutton switch cover member according to claim 2 wherein a polycarbonate resin is used to form the key top, and a thermoplastic polyester elastomer is used to form the key sheet.

4. An illuminated pushbutton switch cover member, comprising:

a key sheet capable of blocking light and formed of a thermoplastic elastomer; and a resin key top capable of blocking light and having a light-blocking layer that covers a portion of the resin key top other than an indicator portion, the indicator portion emitting light from inside upon receiving light from an internal light source provided below the key sheet;

wherein the key sheet is provided with an opening for passage of light through which a bottom side of the resin key top to the internal light source, and a pressing projection for pressing against a contact on a circuit board, said pressing projection being formed on a back side of a portion of the key sheet joined to the resin key top, and wherein the pressing projection projects inwardly in the opening for passage of light.

5. The illuminated pushbutton switch cover member according to claim 4 wherein the key top and the key sheet are integrally combined by being welded to each other.

6. The illuminated pushbutton switch cover member according to claim 4 wherein a transparent layer is formed on the surface of the resin key top, said transparent layer having the function of diffusing light from an internal sight source.

7. The illuminated pushbutton switch cover member according to claim 4 wherein the resin key top has an inner circumferential surface defining a cavity for the passage of light through the resin key top, the cavity having a cavity opening area, the key sheet has an inner circumferential pressing projection surface defining the opening and the opening has an opening area and is in communication with the cavity, the opening area being smaller than the cavity opening area.

8. An illuminated pushbutton switch cover member, comprising:

a key sheet capable of blocking light and formed of a thermoplastic elastomer; and a resin key top capable of blocking light and having a light-blocking layer that covers a portion of the resin key top other than an indicator portion, the indicator portion emitting light from the inside upon receiving light from an internal light source provided below the key sheet;

wherein an opening for passage of light is formed in the key sheet to expose a bottom side of the resin key top to the internal light source, wherein the diameter of the opening for passage of light is shorter than the diameter of the opening of the inner circumferential surface of the resin key top, and wherein the entire inner circumference of the opening for passage of light is inwardly extended.

9. The illuminated pushbutton switch cover member according to claim 8 wherein the key top and the key sheet are integrally combined by being welded to each other.

10. The illuminated pushbutton switch cover member according to claim 8 wherein a transparent layer is formed on the surface of the resin key top, said transparent layer having the function of diffusing light from an internal sight source.

11. An illuminated pushbutton switch cover member, comprising:

a key sheet; and a resin key top jointed to the key sheet, said resin key top having an indicator portion provided therein that emits light from inside upon receiving light from an internal light source provided below the key sheet;

wherein the key sheet is formed of a thermoplastic elastomer and is capable of blocking light, and an opening for passage of light is formed in the key sheet to expose a bottom side of the resin key top to the internal light source, wherein the resin key top has a flange portion extending outward, and a cover portion for covering the flange portion is provided on the key sheet, and wherein a transparent layer is formed on the surface of the resin key top, said transparent layer having the function of diffusing light from an internal sight source.

* * * * *